US006000334A

United States Patent [19]

Suzuki

[11] Patent Number: 6,000,334

[45] Date of Patent: Dec. 14, 1999

[54] PAPER GUIDE UNIT FOR FOLDING MACHINE

[75] Inventor: Seiji Suzuki, Yokohama, Japan

[73] Assignee: Tokyo Kikai Seisakusho, Ltd., Tokyo, Japan

[21] Appl. No.: 09/159,384

[22] Filed: Sep. 23, 1998

[30] Foreign Application Priority Data

Jan. 30, 1998 [JP] Japan ..... 10-032415

[51] Int. Cl.[6] ..... B41F 13/56

[52] U.S. Cl. ..... 101/227; 101/228; 271/187

[58] Field of Search ..... 101/227, 228, 101/230, 411; 271/185, 186, 187; 270/5.02, 13, 19, 47, 49

[56] References Cited

U.S. PATENT DOCUMENTS

| | | | |
|---|---|---|---|
| 3,742,847 | 7/1973 | Zimmermann et al. | 101/230 |
| 4,534,552 | 8/1985 | Rahe | 101/411 |
| 4,537,390 | 8/1985 | Kiamco et al | 271/187 |
| 4,865,307 | 9/1989 | Crofutt et al. | 271/187 |
| 4,925,179 | 5/1990 | Breton et al. | 271/187 |
| 5,049,123 | 9/1991 | Breton et al. | 271/187 |
| 5,131,646 | 7/1992 | Balow | 271/187 |
| 5,156,389 | 10/1992 | Novick | 271/187 |
| 5,249,791 | 10/1993 | Belanger et al. | 271/187 |
| 5,647,586 | 7/1997 | Novick et al. | 271/187 |
| 5,915,301 | 6/1999 | Pollock | 101/227 |

FOREIGN PATENT DOCUMENTS

| | | |
|---|---|---|
| 53-37682 | 9/1978 | Japan . |
| 62-63254 | 4/1987 | Japan . |
| 1-17980 | 4/1989 | Japan . |
| 8-504727 | 5/1996 | Japan . |

*Primary Examiner*—Eugene Eickholt
*Attorney, Agent, or Firm*—Armstrong, Westerman, Hattori, McLeland & Naughton

[57] ABSTRACT

A paper guide unit is disposed in a signature delivery section of a rotary press in which signatures are inserted between vanes of a delivery fan and dropped onto a conveyor located under the delivery fan through rotation of the delivery fan. A guide member located in the vicinity of a rotation area of the delivery fan has a signature guide surface which comes into contact the signatures inserted between vanes of the delivery fan in order to guide them toward the conveyor. A movable unit is provided to support the guide member. The movable unit is reciprocatively movable in a substantially horizontal direction to move the guide member toward or away from the delivery fan. An adjusting unit is linked to the movable unit for moving the guide member toward or away from the delivery fan via the movable unit to thereby adjust the gap between the guide member and the delivery fan. A posture-holding mechanism is further provided in the movable unit for selectively holding the guide member in either a guide posture or an opening posture. In the guide posture, the guide member faces the trajectory of vane tips of the delivery fan so as to guide rear end portions of signatures. In the opening posture, the guide member is angularly displaced far away from the delivery fan and does not face the trajectory.

2 Claims, 5 Drawing Sheets

PAPER GUIDE UNIT FOR FOLDING MACHINE

BACKGROUND OF THE INVENTION

1. Field of the Invention

The present invention relates to a signature delivery section of a folding machine of a rotary press. More particularly, the invention relates to a paper guide unit in a signature delivery section of a folding machine of a rotary press. The folding machine allows the size of signatures to be varied arbitrarily. The paper guide unit comes into contact with and guides rear end portions of signatures projecting from the circumference of a delivery fan while the signatures are received in the delivery fan and then drop onto a conveyor located under the delivery fan.

2. Description of the Related Art

In a rotary press, web printed in a printing section is folded and cut at a folding machine to become signatures. The signatures are sent to a delivery fan in a signature delivery section.

Each signature drops in a vertical posture into a space defined by adjacent vanes of the delivery fan. Each signature is received in its space with its rear end portion projecting from the circumference of the delivery fan. As the delivery fan rotates, each signature is rotationally moved and changes its posture from vertical to horizontal. As the delivery fan rotates further, each signature is further moved rotationally and drops onto a conveyor located under the delivery fan.

The conveyor is vertically movable in accordance with signature thickness, so that the gap between the circumference of the delivery fan and the upper surface of the conveyor can be adjusted in accordance with signature thickness.

Through the above-mentioned gap adjustment, signatures are conveyed on the conveyor without jamming.

In order to prevent flutter or droop of signature rear end portions projecting from the circumference of the delivery fan, there is generally provided a paper guide unit which comes into contact with signature rear end portions in order to guide them toward the conveyor.

A conventional technique related to the above-mentioned paper guide unit is disclosed in, for example, Japanese Utility Model Publication No. 53-37682 and Japanese Patent Publication No. 1-17980.

The paper guide unit disclosed in Japanese Utility Model Publication No. 53-37682 has a paper guide whose shape corresponds to the trajectory of vane tips of a rotating delivery fan.

The paper guide has a mechanism for coping with a signature jam. Specifically, upon a signature jamming between the delivery fan and the paper guide for some reason, the jamming pressure causes the paper guide to move parallel away from the delivery fan against a spring force.

The paper guide unit disclosed in Japanese Patent Publication No. 1-17980 includes movable means and adjusting means. The movable means enables a paper guide to move away from a delivery fan along rails provided on both sides of the paper guide. The adjusting means enables an operator to move the movable means through operation of a handle so as to adjust the gap between the delivery fan and the paper guide.

The paper guide unit disclosed in Japanese Utility Model Publication No. 53-37682 does not have adjusting means for adjusting the gap between the delivery fan and the paper guide through movement of the paper guide away from the delivery fan. Thus, even when the size of signatures is changed, the gap between the delivery fan and the paper guide cannot be adjusted accordingly. Consequently, signature rear end portions projecting from the circumference of the delivery fan cannot come into proper contact the paper guide. Specifically, the following problems are involved.

(1) When the gap between the delivery fan and the paper guide is excessively wide for the size of signatures, rear end portions of signatures may not come into contact with the paper guide or may come into only slight contact. As a result, the signature rear end portion may flutter, droop, or exhibit like behavior while the signature is rotationally moved with rotation of the delivery fan.

Subsequently, the signature drops onto a conveyor such that its rear end portion is knocked down on the conveyor surface. The impact causes the signature rear end portion to jump up on the conveyor surface. As a result, leaves of the signature may be turned over at a corner section or across the entire width of the signature rear end portion. A subsequent signature drops onto and presses the turned-over leaves, causing formation of a fold at the signature rear end portion.

(2) When the gap between the delivery fan and the paper guide is excessively narrow for the size of signatures, a contact area between rear end portions of signatures and the paper guide becomes relatively large, resulting in an increase in frictional resistance therebetween. This disturbs the timing of the signature rear end portion dropping onto a conveyor. For example, the dropping may be delayed.

As a result, signatures fail to drop onto the conveyor in an orderly manner and be conveyed at regular overlapping intervals.

If a signature drops onto the conveyor in a misaligned manner, the signature may be caught by a side plate or the like provided on either side of the conveyor and serving as a paper guide, thus remaining in place on the conveyor. As a result, following signatures will accumulate on the stopped signature, causing signature jamming.

The paper guide unit disclosed in Japanese Patent Publication No. 1-17980 has the adjusting means for enabling an operator to horizontally move the paper guide toward or away from the delivery fan so as to adjust the gap between the paper guide and the delivery fan in accordance with the size of signatures.

However, the paper guide is in a flat shape, which does not correspond to the trajectory of vane tips of a rotating delivery fan.

Further, the paper guide faces the delivery fan in a substantially vertical posture. Accordingly, the gap between the delivery fan and the paper guide is not constant over the entire paper guide. In other words, the gap becomes relatively wide at a certain point on the paper guide and becomes relatively narrow at another point. Even though the gap is adjusted according to the size of signatures through movement of the paper guide effected with the adjusting means, there are involved problems similar to those in the case of the above-mentioned paper guide unit disclosed in Japanese Utility Model Publication No. 53-37682.

Also, even when signature jamming occurs on the conveyor and propagates up to the gap between the delivery fan and the paper guide due to accumulation of following signatures, the paper guide is not adapted to respond to an increased jam pressure and move away from the delivery fan, resulting in a mechanical breakage.

Further, since the paper guide cannot be moved far away from the delivery fan during work for coping with a signature jam, a worker takes a long time and must perform burdensome operation to remove jammed signatures, so that a significant burden is imposed the worker.

SUMMARY OF THE INVENTION

An object of the present invention is to solve the above mentioned problems involved in the conventional paper guide unit for a folding machine and to provide a paper guide unit for a folding machine in which the gap between a delivery fan and a paper guide is substantially constant over the entire paper guide and can be adjustably increased or decreased in substantially the same amount over the entire paper guide.

Through use of the paper guide unit of the present invention, a signature rear end portion is guided toward the conveyor by the paper guide such that the contact area and the frictional resistance between the signature rear end portion and the paper guide are maintained substantially constant, and thus the signature rear end portion smoothly drops onto the conveyor.

As a result, a signature end portion is free from a turnover or folding of leaves. Further, signatures are conveyed on the conveyor in an orderly manner without irregular overlapping intervals of signatures, occurrence of an out-of-place signature, or the like.

Another object of the present invention is to provide a paper guide unit for a folding machine in which, when signature jamming occurs between the delivery fan and the paper guide, the paper guide moves away from the delivery fan in accordance with a jamming pressure, thereby preventing a mechanical breakage which would otherwise result due to the jamming pressure.

Still another object of the present invention is to provide a paper guide unit for a folding machine having a mechanism for moving the paper guide far away from the delivery fan for worker's convenience of removal of jamming signatures or maintenance work.

The paper guide unit of the present invention is provided in a signature delivery section of a rotary press. In the rotary press, web printed in a printing section is folded and cut at a folding section to become signatures. Each signature is inserted between vanes of a delivery fan. As the delivery fan rotates, signatures received in the delivery fan sequentially drop onto a conveyor located under the delivery fan.

The paper guide unit comprises a guide member, movable means, adjusting means, and posture-holding means. The guide member is located in the vicinity of a rotation area of the delivery fan and has a signature guide surface having a shape substantially corresponding to the trajectory of vane tips of the rotating delivery fan. The signature guide surface comes into contact with rear end portions of signatures inserted between vanes of the delivery fan in order to guide the signatures toward the conveyor. The movable means supports the guide member and is reciprocatively movable in a substantially horizontal direction to allow movement of the guide member toward or away from the delivery fan. The adjusting means is linked to the movable means and moves the guide member supported by the movable means toward or away from the delivery fan via the movable means to thereby adjust the gap between the guide member and the delivery fan. The posture-holding means is provided in the movable means and selectively holds the guide member in either a guide posture or an opening posture. In the guide posture, the guide member faces the trajectory of vane tips of the delivery fan so as to guide rear end portions of signatures. In the opening posture, the guide member is angularly displaced far away from the delivery fan and does not face the trajectory.

Preferably, the adjusting means comprises a mechanism for continuously applying to the movable means such a force as to urge the movable means toward the delivery fan, and a moving mechanism for moving the movable means away from the delivery fan against the force.

The paper guide unit of the present invention can adjust the gap between the delivery fan and the paper guide in accordance with the size of signatures.

Accordingly, when a signature drops onto the conveyor, its rear end portion is free from a turnover or folding of leaves, thereby preventing an impairment in the commercial value of a signature, which is a printed material.

Also, since signature jamming hardly occurs on the conveyor, a worker is immune from removal of jamming signatures. Thus, a worker's load is reduced, resulting in improvement in work efficiency.

If a signature jam should occur for some reason, a worker can easily remove jamming signatures, since the paper guide can be moved far away from the delivery fan. This feature also facilitates machine maintenance, and thus a worker's load is reduced, resulting in improvement in work efficiency. Further, in the paper guide unit of the present invention, the adjusting means comprises a mechanism for continuously applying to the movable means such a force as to urge the movable means toward the delivery fan, and a moving mechanism for moving the movable means away from the delivery fan against the force. Therefore, it is possible to prevent a mechanical breakage which would otherwise occur due to occurrence of a signature jam between the delivery fan and the paper guide.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DESCRIPTION OF THE INVENTION AND THE PREFERRED EMBODIMENT

Figure 1:
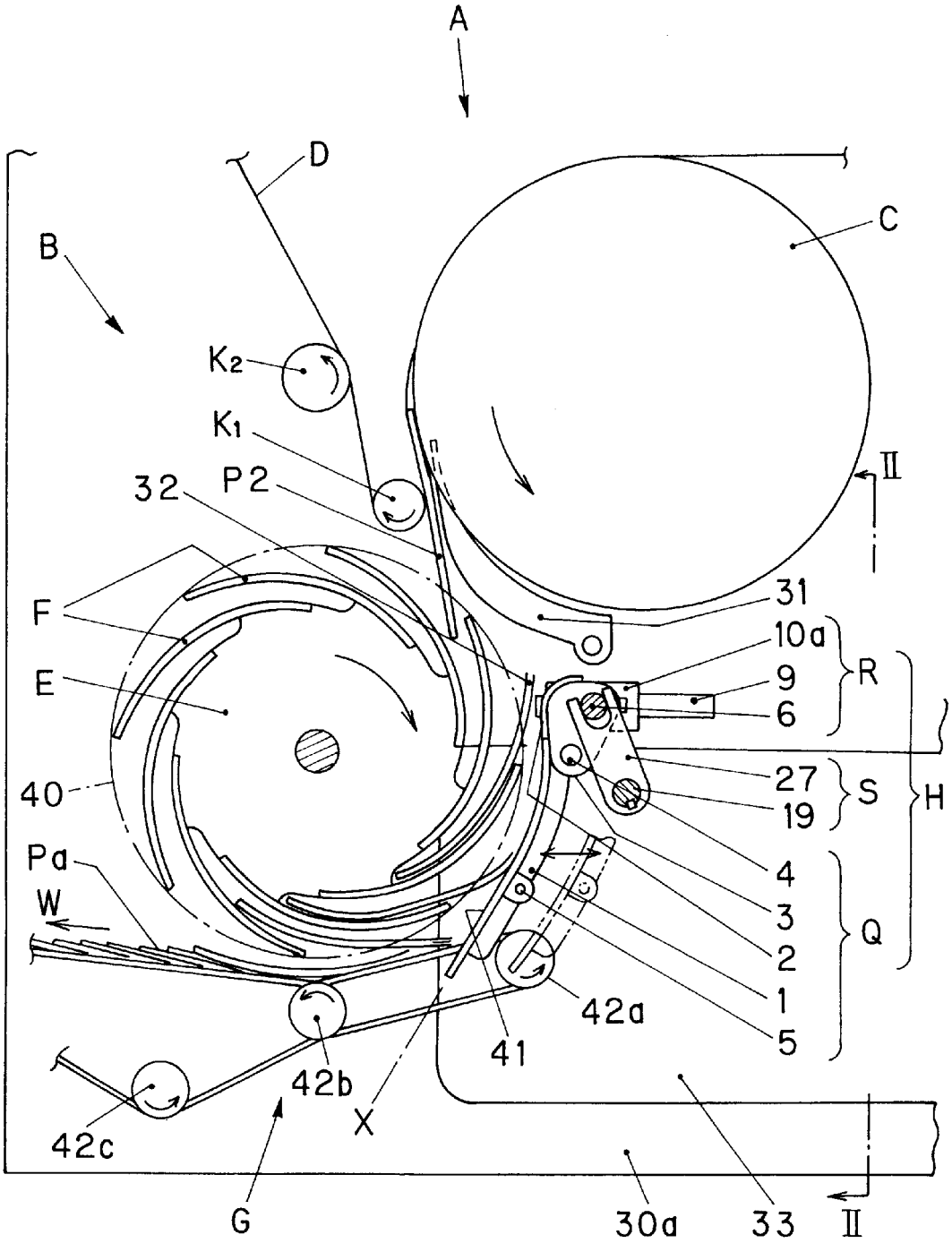
FIG. 1 is a sectional view showing the major configuration of a signature delivery section of a folding machine according to an embodiment of the present invention.

In a folding machine, web printed by a printing machine is folded and cut at a folding section to become signatures. The signatures are conveyed while being held between a jaw cylinder and a delivery belt. Upon arrival at a release position, the signatures are released and drop in a vertical posture along a guide plate.

Each of the dropping signatures is received in a space defined by adjacent vanes of a delivery fan. As the delivery fan rotates, each signature is rotationally moved and changes its posture from vertical to horizontal while its rear end projects beyond vane tips. During the rotational movement of each signature, its projecting rear end is in contact with a guide member of a paper guide unit located between the guide plate and a conveyor, thereby being guided and displaced toward the conveyor.

The conveyor travels, in a lower region of the delivery fan, along the outer circumference of the delivery fan at a speed that has a predetermined relation with a circumferential speed of the rotating delivery fan, and then leaves the outer circumference of the delivery fan. Thus, upon arrival at the lower region of the delivery fan, each signature is sequentially removed from the delivery fan and transferred onto the conveyor. The signatures overlap each other at constant intervals on the conveyor and are conveyed out from the folding machine in a row.

In the above-mentioned paper guide unit for a folding machine, the signature guide surface of the guide member is adjusted in the following manner.

The gap between the signature guide surface of the guide member held in the signature guide posture and the trajectory of vane tips of the rotating delivery fan is adjusted through adjustment of the movable means, which supports the guide member to move the guide member toward or away from the delivery fan, is reciprocatively movable in a substantially horizontal direction, and continuously receives a force in a direction to approach the delivery fan. Specifically, for such adjustment, the movable means is moved by the adjusting means in such directions that the guide member moves toward and away from the delivery fan.

In the above-mentioned paper guide unit for a folding machine, when, during operation of the rotary press, paper jamming occurs in the gap between the signature guide surface of the guide member and the trajectory of vane tips of the rotating delivery fan, an operator operates the posture-holding means so as to shift the guide member from the signature guide posture to the opening posture and to fix the guide member in the opening posture. In the guide posture, the guide member faces the trajectory of vane tips of the delivery fan so as to guide rear end portions of signatures. In the opening posture, the guide member is angularly displaced far away from the delivery fan and does not face the trajectory.

Accordingly, the operator can easily remove jamming signatures from the folding machine. Also, machine maintenance can be easily performed.

After the paper jam is remedied, the operator operates the posture-holding means so as to return the guide member to the signature guide posture and to fix the guide member in the posture. Then, the operator operates the adjusting means so as to horizontally move the guide member to a position suited for the size of signatures. Through restart of the rotary press, signatures are guided toward the conveyor and conveyed out from the folding machine in a row.

An embodiment of the present invention will now be described with reference to the drawings.

First will be described a signature delivery section B in a folding machine A of a rotary press. As shown in FIG. 1, the signature delivery section B is located between frames 30*a* and 30*b* (see FIG. 2) of the folding machine A. The signature delivery section B includes a jaw cylinder C, a delivery belt D, a delivery fan E, a conveyor G, and a paper guide unit H, which will be described in detail later.

The jaw cylinder C having an unillustrated gripping member on its circumferential surface is supported by the frames 30*a* and 30*b* in such a manner as to be rotatable counterclockwise about an axis perpendicular to the plane of the paper of FIG. 1. The delivery belt D approaches the outer circumference of the jaw cylinder C over an appropriate range and are looped around rollers K1 and K2. The delivery belt D runs synchronously with the jaw cylinder C in the same direction as the rotational direction of the jaw cylinder C, i.e., in the direction of the arrow. At least one guide plate 31 is provided at a release position which is located adjacent to the roller K1 and at which the delivery belt D leaves the outer circumference of the jaw cylinder C.

Web printed in an unillustrated printing machine is folded and cut at an unillustrated folding section of the folding machine A to become a signature P. The signature P is conveyed while being held between the jaw cylinder C and the delivery belt D, with its front end portion being gripped by the gripping member of the jaw cylinder C. The gripping member is adapted to release the signature P at the release position. The guide plate 31 is provided for guiding the signature P which is released from hold effected by the delivery belt D and the jaw cylinder C and from the gripping member's grip and then drops in a vertical posture into a space defined by adjacent vanes F of the delivery fan E.

The delivery fan E includes a number of vanes F arranged regularly in an obliquely radiant fashion. The delivery fan E is supported by the frames 30*a* and 30*b* in such a manner as to be rotatable clockwise about an axis perpendicular to the plane of the paper of FIG. 1. The delivery fan E is positioned such that the space defined by the adjacent vanes F opens upward toward the release position in the right-hand circumferential region of the delivery fan E.

Figure 2:
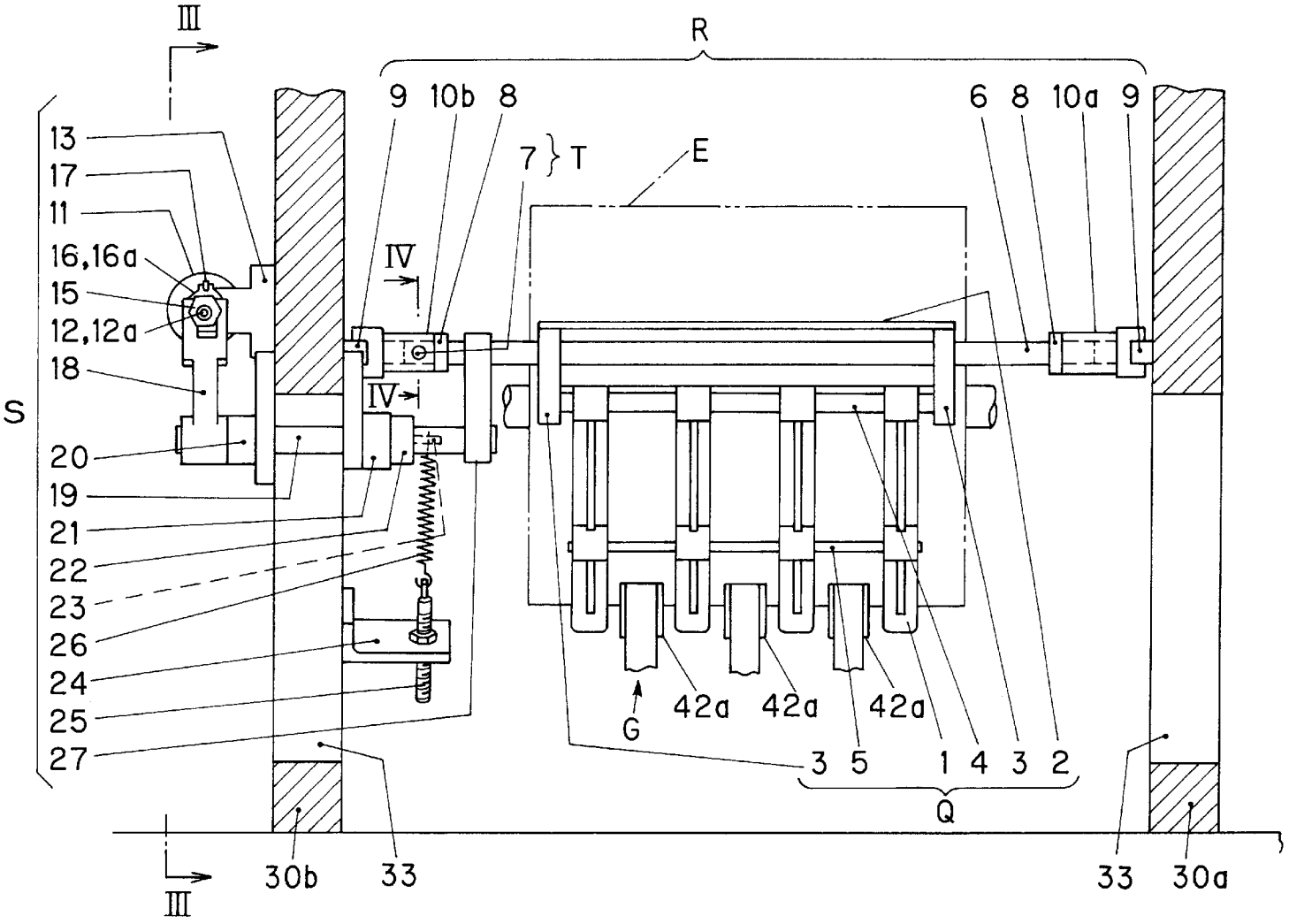
FIG. 2 is a sectional view taken along the line II—II of FIG. 1.

The 2-continuous-section (upstream and downstream) conveyor G is located under the delivery fan E. The conveyor G includes a plurality of parallel spaced conveyor belts that approach the outer circumference of the delivery fan E over an appropriate range and are looped around rollers 42*a*, 42*b*, and 42*c*. The conveyor belts run in the same direction as the rotational direction of the delivery fan E, i.e., in a direction W of the arrow of FIG. 1 at a speed that has a predetermined relation with a circumferential speed of the rotating delivery fan E. FIGS. 1 and 2 show the upstream section of the conveyor G, which includes three conveyor belts looped around the spaced upstream rollers 42*a*.

In the above-described folding machine A, web printed in an unillustrated printing machine is folded and cut at an unillustrated folding section of the folding machine A to become a signature P. The signature P is conveyed while being held between the jaw cylinder C and the delivery belt D, with its front end portion being gripped by the gripping member of the jaw cylinder C. Upon arrival at the release position, the signature P is released from hold effected by the jaw cylinder C and the delivery belt D and from the gripping member's grip and then drops in a vertical posture along the guide plate 31.

The release intervals of the conveyed signatures P are identical to the displacement intervals of the vanes F of the rotating delivery fan E. Accordingly, each of the dropping signatures P enters from its front end into a space defined by the adjacent vanes F, i.e., by the leading vane F and the following vane F. As the delivery fan E rotates (clockwise), each signature P is rotationally conveyed and changes its posture from vertical to horizontal while its rear end projects beyond the tip of the leading vane F. Since the paper guide unit H, which will be described later, is provided between the guide plate 31 and the conveyor G, during the rotational conveyance of each signature P, the projecting rear end of the signature P is in contact with the guide member Q of the paper guide unit H, thereby being guided and displaced toward the conveyor.

The conveyor G travels, in a lower region of the delivery fan E, along the outer circumference of the delivery fan E rotating clockwise in FIG. 1, at a speed that has a predetermined relation with a circumferential speed of the rotating delivery fan E. Then, the conveyor G leaves the outer circumference of the delivery fan E leftward in FIG. 1, i.e., in a direction of the arrow W of FIG. 1. Thus, upon arrival at the lower region of the delivery fan E, each signature P is sequentially removed from the space defined by the adjacent vanes F and transferred onto the conveyor G. The signatures P overlap each other at constant intervals on the conveyor G and are conveyed out from the folding machine A in a row Pa.

The paper guide unit H in the folding machine A is located in a rear (right-hand in FIG. 1) circumferential region of the delivery fan E between the guide plate 31 and the upstream end of the conveyor G. The paper guide unit H includes the guide member Q, movable means R, adjusting means S, and posture-holding means T, which are described below.

(1) Guide member Q

The guide member Q has a signature guide surface 41 which comes into contact with a rear end portion 32 of the signature P conveyed by the delivery fan E to thereby guide the signature rear end portion 32 toward the conveyor G.

As shown in FIG. 2, a shaft 6 of the movable means R, which will be described later, is supported by and extends between the frames 30*a* and 30*b*. The guide member Q is mounted on the shaft 6 in such a manner as to face the delivery fan E.

End portions of blocks 3 are attached onto the shaft 6 such that the blocks 3 are spaced apart from each other in an amount substantially corresponding to an axial length of the delivery fan E. That is, the blocks 3 are positioned in such a manner as to face corresponding end regions of the delivery fan E (see FIG. 2). Ends of a shaft 4 are attached to the corresponding other end portions of the blocks 3. Base portions of a plurality of (four in FIG. 2) parallel paper guides 1 are attached to the shaft 4 such that the paper guides 1 are equally spaced.

The paper guide 1 is a circularly curved bar having a T-shaped cross section and including a flange portion and a rib portion. The flange portion has the signature guide surface 41 which is circularly curved substantially in parallel with the outer circumference of the delivery fan E, i.e., substantially along a trajectory 40 of vane tips of the rotating delivery fan E. A shaft 5 extends in parallel with the shaft 4 through the rib portions, each of which is located at a central portion of each paper guide 1. The shaft 5 integrates the paper guides 1 into a single unit (see FIGS. 1 and 2).

Figure 6:
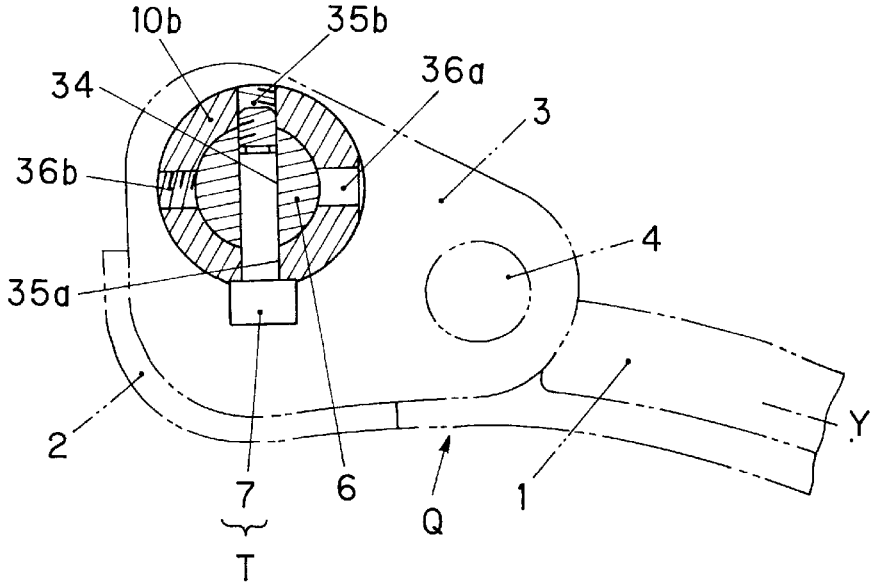
FIG. 6 is a sectional view taken along the line IV—IV of FIG. 2, illustrating an operation of fixing the guide member.

Both ends of an elongated-plate-like paper guide 2 are attached onto the corresponding blocks 3. The paper guide 2 abuts and is flush with upper end sections of the flange portions of the paper guides 1 so that the paper guide 2 and the flange portions of the paper guides 1 form the continuous signature guide surfaces 41 (see FIGS. 1 and 6).

As mentioned previously, the signature P conveyed by the delivery fan E is guided such that its projecting rear end comes into contact with the signature guide surfaces 41.

As shown in FIG. 2, the tips of the paper guides 1 and the upstream rollers 42*a* of the conveyor G are positioned such that they alternate with each other in an interlaced manner so as to avoid mutual interference.

(2) Movable means R

The movable means R supports the guide member Q and enables the guide member Q to move in a horizontal direction.

As shown in FIG. 2, rails 9 are horizontally fixed on the inner surfaces of the respective frames 30*a* and 30*b* in such a manner as to face each other. Sliders 10*a* and 10*b* are attached onto the side surfaces of the respective rails 9 such that the sliders 10*a* and 10*b* are reciprocatively movable in a horizontal direction along the rails 9. Specifically, the slider 10*a* (10*b*) includes an engagement portion and a cylindrical portion. The engagement portion is slidably engaged with the rail 9. The cylindrical portion projects from the engagement portion horizontally and perpendicularly to the rail 9. The cylindrical portions of the sliders 10*a* and 10*b* face each other on the same axis.

End portions of the shaft 6 are rotatably inserted into the corresponding cylindrical portions of the sliders 10*a* and 10*b* such that collars 8 mounted on the shaft end portions abut the corresponding end surfaces of the cylindrical portions of the slides 10*a* and 10*b*. Accordingly, the shaft 6 is supported by the sliders 10*a* and 10*b* such that it is rotatable while its axial movement is restricted. As mentioned previously, the guide member Q is mounted on an intermediate portion of the shaft 6.

(3) Posture-holding means T

The posture-holding means T is adapted to hold the shaft 6, i.e., the guide member Q, relative to the movable means R, in either signature guide posture X or in the guide opening posture Y. When the guide member Q is in the signature guide posture X, the guide member Q faces the delivery fan E. When the guide member Q is in the guide opening posture Y, a large space is formed between the delivery fan E and the guide member Q.

In the cylindrical portion of the slider 10*b* located on the side of the adjusting means S, which will be described later, (see FIG. 2), holes 35*a*, 35*b*, 36*a*, and 36*b* are diametrically formed through the cylindrical portion such that the axis of the holes 35*a* and 35*b* and the axis of the holes 36*a* and 36*b* intersect perpendicularly with each other. The holes 35*a* and 36*a* are bolt holes, and the holes 35*b* and 36*b* are threaded holes.

A hole 34 having the same diameter as that of the holes 35*a* and 36*a* is formed through the end portion of the shaft 6. In a state in which the shaft 6 is inserted into the cylindrical portion of the slider 10*b*, the hole 34 aligns with the holes 35*a* and 35*b* or the holes 36*a* and 36*b*.

When the hole 34 is aligned with the holes 35*a* and 35*b* or the holes 36*a* and 36*b*, a bolt 7 is fastened into the holes 34, 35*a*, and 35*b* or the holes 34, 36*a*, and 36*b*. As a result, the shaft 6, i.e., the guide member Q is selectively positioned in either of two angular positions, which are shifted by 90 degrees from each other.

Figure 5:
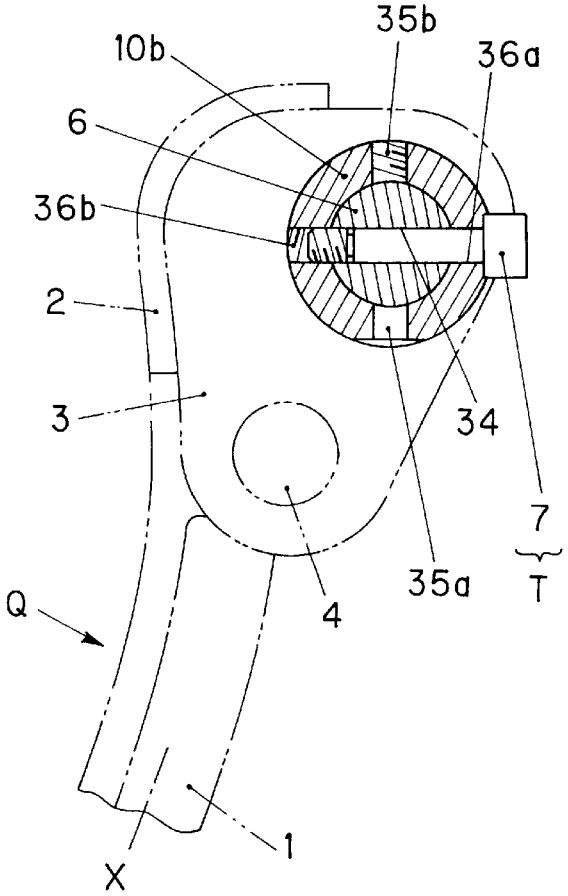
FIG. 5 is a sectional view taken along the line IV—IV of FIG. 2, illustrating an operation of fixing a guide member.

Specifically, when the bolt 7 is fastened into the holes 34, 36*a*, and 36*b*, the guide member Q is held in the signature guide posture X and faces the delivery fan E (see FIG. 5). When the bolt 7 is fastened into the holes 34, 35*a*, and 35*b*, the guide member Q is held in the guide opening posture Y, so that a large space is formed between the delivery fan E and the guide member Q (see FIG. 6).

(4) Adjusting means S

The adjusting means S is adapted to move the guide member Q via the movable means R so as to adjust the gap between the delivery fan E and the guide member Q.

As shown in FIG. 2, open windows 33 are respectively formed in the frames 30*a* and 30*b* under the rails 9. Base portions of brackets 20 and 21 are attached respectively onto the outer and inner surfaces of the frame 30*b*. Tip portions of the brackets 20 and 21 rotatably support a shaft 19 which extends through the window 33 in its upper region.

A bossing portion of an arm 27 is fixedly attached through use of a key to an end portion of the shaft 19 extending further inward from the bracket 21 on the inner surface side of the frame 30*b*. A forked tip portion of the arm 27 is engaged with the shaft 6 in a pinching manner (see FIG. 1).

A bossing portion of an arm 22 is fixed onto the shaft 6 at a position between the bracket 21 and the arm 27. A pin 23 is fixedly mounted at a tip portion of the arm 22 (see FIGS. 2 and 3).

A bottom portion of an L-shaped bracket 24 is fixedly mounted on the frame 30*b*. A threaded shaft 25 is attached to a projecting portion of the bracket 24 such that the threaded shaft 25 is located a certain distance away from the pin 23 attached to a tip portion of the arm 22 and extends toward the pin 23. A pair of nuts are fixedly screw-engaged with the threaded shaft 25 from both sides of the bracket 24 such that the position of the threaded shaft 25 is adjustable in an axial direction of the shaft 25.

One end of a tensile coil spring 26 is engaged with the pin 23 attached to a tip end portion of the arm 22. The other end of the spring 26 is engaged with the tip of the threaded shaft 25. Thus, a spring force of the spring 26 is applied to the arm 22 in such a manner as to rotate the arm 22 counterclockwise in FIG. 3. As a result, a rotational force is applied to the shaft 19 in such a manner as to rotate the shaft 19 counterclockwise in FIG. 3.

A bracket 13 is mounted on the outer surface of the frame 30*b* and located obliquely above the bracket 20. A base portion of a threaded shaft 12 is rotatably supported by the bracket 13, while an axial movement of the shaft 12 is restricted. The threaded shaft 12 is oriented vertically in FIG. 2 and horizontally in FIG. 3 and has a handle 11 at its one end. Two stoppers 14 and 15 are attached onto a threaded portion 12*a* extending from the base portion of the threaded shaft 12, and spaced adequately in an axial direction. Each stopper 14 or 15 is a combination of a nut and a lock nut. Further, a block 16 is mounted on the threaded portion 12*a* and located between the stoppers 14 and 15. The block 16 has a threaded hole formed therein and a flange portion 16*a*.

A bar-like guide 17 is located above and in parallel with the threaded shaft 12. A base portion of the guide 17 is mounted on the bracket 13. The guide 17 is fitted into a cut formed in the flange portion 16*a* of the block 16. Accordingly, the block 16 is movable in an axial direction of the threaded shaft 12, but its rotation is restricted. Thus, as the threaded shaft 12 is rotated, the block 16 moves on the shaft 12 reciprocatively between the stoppers 14 and 15.

A bossing portion of an arm 18 is fixedly attached through use of a key to an end portion of the shaft 19 extending further outward from the bracket 20 on the outer surface side of the frame 30*b*. A forked tip portion of the arm 18 is engaged with the block 16 in a pinching manner. As mentioned previously, a spring force of the tensile coil spring 26 applies a counterclockwise (in FIG. 3) rotational force to the shaft 19. Accordingly, the same rotational force as that acting on the shaft 19 acts on the arm 18; thus, the arm 18 is angularly displaced until its tip portion comes into contact with the flange portion 16*a* of the block 16.

Next will be described an adjustment procedure for the signature guide surface 41 of the guide member Q in the above-mentioned paper guide unit of the folding machine as well as a remedial action to cope with jamming of the signatures P.

(a) In FIG. 1, the guide member Q is held in the signature guide posture X. In order to adjust the gap between the signature guide surface 41 and the trajectory 40 of vane tips of the rotating delivery fan E, first, the handle 11 of the adjusting means S (FIG. 3) is manually rotated to thereby rotate the threaded shaft 12. As the threaded shaft 12 rotates, the block 16 screw-engaged with the shaft 12 moves accordingly. This causes an angular displacement of the arm 18, whose tip portion is pressed against the flange portion 16*a* of the block 16 by the force of the spring 26. Thus, the shaft 19 is angularly displaced accordingly.

When the shaft 19 is angularly displaced, the arm 27 shown in FIG. 1 is also angularly displaced. Thus, a forked tip end portion of the arm 27 is urged to move the shaft 6 of the movable means R. Therefore, the shaft 6 is moved horizontally (FIG. 1) along the rails 9 via the sliders 10*a* and 10*b*. As a result, the guide member Q supported by the shaft 6 moves accordingly, so that the gap between the signature guide surface 41 of the guide member Q and the trajectory 40 of the delivery fan E is adjusted adequately.

(b) In FIG. 1, when, during operation of a rotary press, jamming of the conveyed signatures P occurs in the gap between the signature guide surface 41 of the guide member Q and the trajectory 40 of tips of the vanes F of the delivery fan E, the jamming pressure presses the signature guide surface 41, i.e., the guide member Q in a direction of moving away from the delivery fan E (rightward in FIG. 1). Thus, the arm 27, i.e., the arm 22 is angularly displaced clockwise in FIG. 3 against the spring force of the tensile coil spring 26. Accordingly, the arm 18 is angularly displaced in such a direction that a tip portion of the arm 18 moves away from the flange portion 16*a* of the block 16. Therefore, an angular displacement of the arm 27 is not restricted.

(c) When jamming of the signatures P occurs, an appropriate one of the above-mentioned displacements is detected by an unillustrated detector. Upon reception of a detection signal from the detector, the running rotary press stops.

(d) After the rotary press stops, in order to prevent a tensile force of the spring 26 from causing the arm 18 to return toward its original position, i.e., to prevent the guide member Q from returning toward its original position, an operator turns the handle 11 so as to move the block 16 rightward until a forked tip portion of the arm 18 again comes into contact with the flange portion 16*a* of the block 16.

Figure 4:
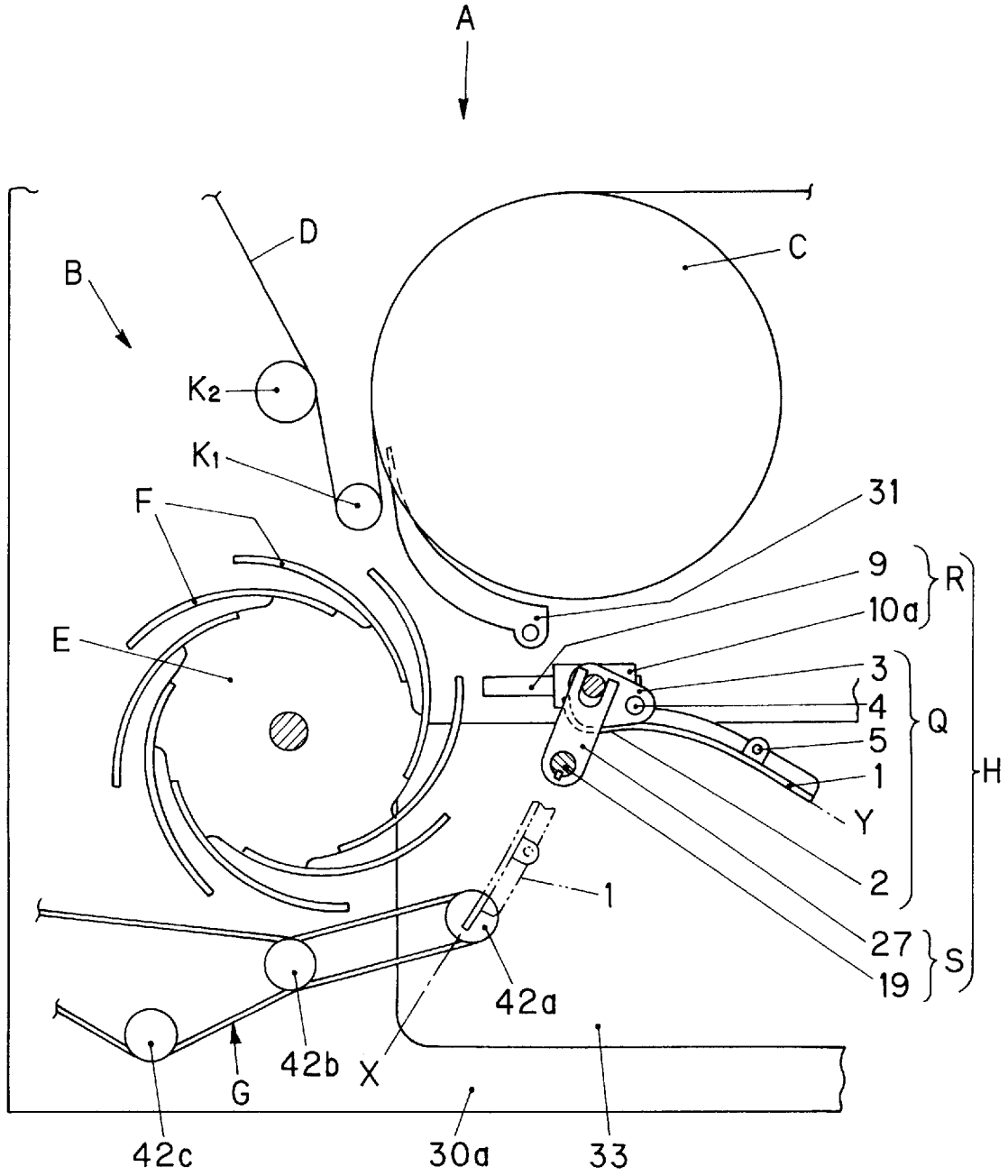
FIG. 4 is a sectional view showing the movement of a paper guide in the signature delivery section of the folding machine of FIG. 1.

(e) Subsequently, the bolt 7 of the posture-holding means T is removed from the holes 36*a* and 36*b*. Further, the guide member Q is angularly displaced about the shaft 6 so as to move the guide member Q far away from the delivery fan E until the hole 34 formed in the shaft 6 aligns with the holes 35*a* and 35*b* formed in the slider 10*b*. Then, the bolt 7 is fastened to thereby fix the slider 10*b*. As a result, as shown in FIG. 4, the guide member Q is fixedly held in the guide opening posture Y.

Thus, the jamming signatures P can be easily removed from a folding machine. Also, machine maintenance is facilitated.

(f) After the paper jam is remedied, the regular operating condition is restored in the following manner. The posture-holding means T is operated so as to return the guide member Q to the signature guide posture X. The guide member Q is fixedly held in the posture X with the posture-holding means T. As described above in (a), the handle 11 of the adjusting means S is operated so as to horizontally move the guide member Q to a position suited for the size of the signature P.

Through restart of the rotary press, the signatures P are guided toward the conveyor G and conveyed out from the folding machine in the row Pa.

Figure 3:
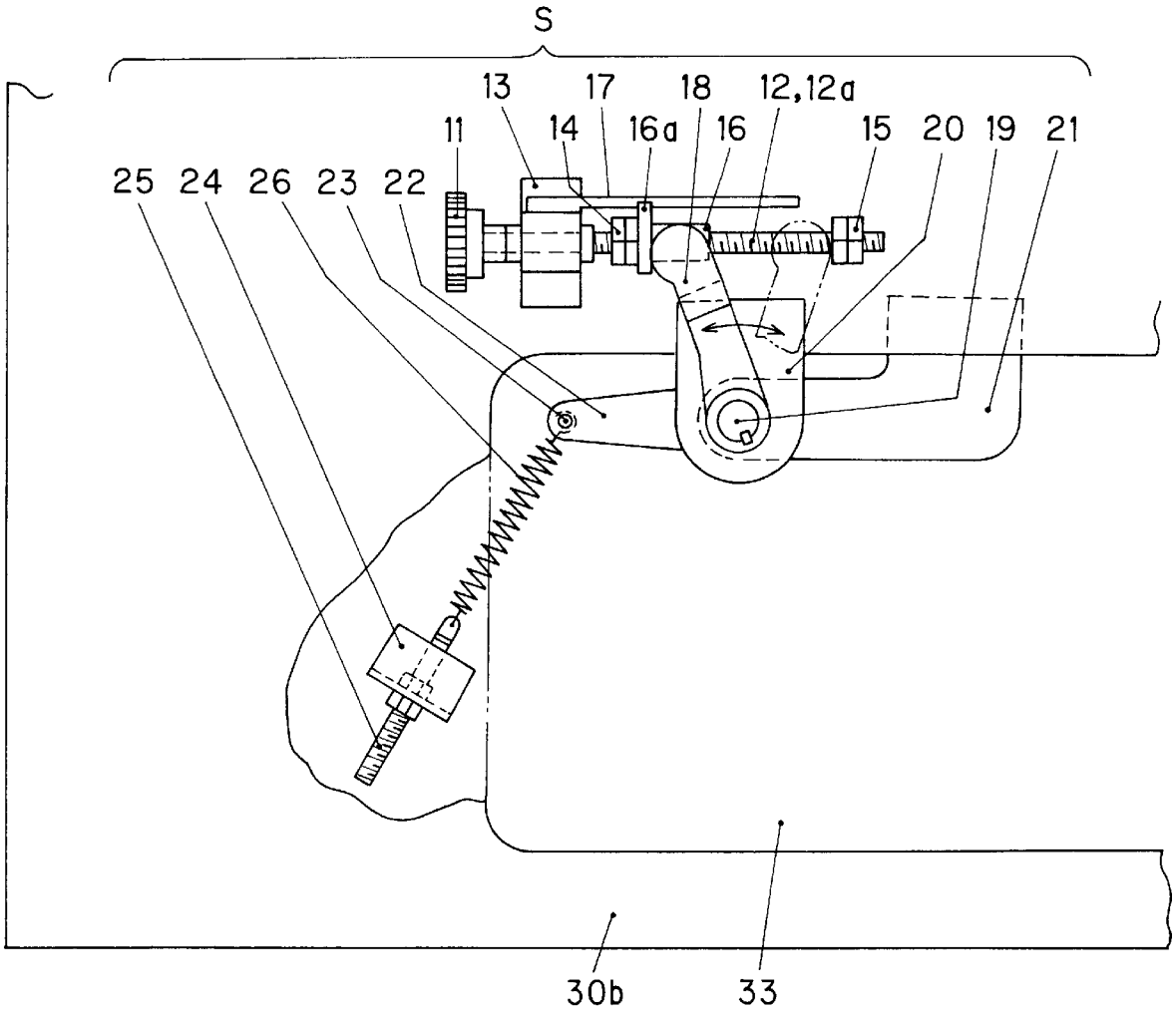
FIG. 3 is a sectional view taken along the line III—III of FIG. 2.

(g) In the above embodiment, the threaded shaft 12 of the adjusting means S shown in FIG. 3 is manually rotated by means of the handle 11. However, drive means such as a motor may be connected to the threaded shaft 12 in order to rotate the shaft 12 for adjusting the guide member Q.

Obviously, numerous modifications and variations of the present invention are possible in light of the above teachings. It is therefore to be understood that within the scope of the appended claims, the present invention may be practiced otherwise than as specifically described herein.

What is claimed is:

1. A paper guide unit for a folding machine disposed in a signature delivery section of a rotary press in which web printed in a printing section of the rotary press is folded and cut at a folding section of the rotary press to produce signatures, which are then inserted between vanes of a delivery fan and dropped onto a conveyor located under the delivery fan through rotation of the delivery fan, said paper guide unit comprising:

a guide member located in the vicinity of a rotation area of the delivery fan and having a signature guide surface having a shape substantially corresponding to the trajectory of vane tips of the rotating delivery fan, the signature guide surface coming into contact with rear end portions of signatures inserted between vanes of the delivery fan in order to guide the signatures toward the conveyor;

movable means for supporting said guide member and for being reciprocatively movable in a substantially horizontal direction to move said guide member toward or away from the delivery fan;

adjusting means linked to said movable means for moving said guide member supported by said movable means toward or away from the delivery fan via said movable means to thereby adjust the gap between said guide member and the delivery fan; and posture-holding means provided in said movable means for selectively holding said guide member in either a guide posture or an opening posture, said guide member in the guide posture facing the trajectory of vane tips of the delivery fan so as to guide rear end portions of signatures, said guide member in the opening posture being angularly displaced far away from the delivery fan and not facing the trajectory.

2. A paper guide unit for a folding machine according to claim 1, wherein said adjusting means comprises a mechanism for continuously applying to said movable means such a force as to urge said movable means toward the delivery fan, and a moving mechanism for moving said movable means away from the delivery fan against the force.

* * * * *